US011293183B2

(12) United States Patent
Guo et al.

(10) Patent No.: US 11,293,183 B2
(45) Date of Patent: Apr. 5, 2022

(54) PRECAST COLUMN BASE JOINT AND CONSTRUCTION METHOD THEREFOR

(71) Applicants: CHINA STATE CONSTRUCTION ENGINEERING CORPORATION LIMITED, Beijing (CN); China State Construction Academy Corporation Limited, Beijing (CN)

(72) Inventors: Haishan Guo, Beijing (CN); Hu Qi, Beijing (CN); Kang Liu, Beijing (CN); Liming Li, Beijing (CN); Xin Fan, Beijing (CN); Lida Tian, Beijing (CN); Jiao Geng, Beijing (CN); Dongyan Wang, Beijing (CN)

( * ) Notice: Subject to any disclaimer, the term of this patent is extended or adjusted under 35 U.S.C. 154(b) by 231 days.

(21) Appl. No.: 16/700,022

(22) Filed: Dec. 2, 2019

(65) Prior Publication Data

US 2020/0102751 A1 Apr. 2, 2020

Related U.S. Application Data

(63) Continuation of application No. PCT/CN2018/088162, filed on May 24, 2018.

(30) Foreign Application Priority Data

Jun. 2, 2017 (CN) ..... 201710407160.1

(51) Int. Cl.
*E04C 5/16* (2006.01)
*E04C 3/34* (2006.01)
(Continued)

(52) U.S. Cl.
CPC ..... *E04C 5/165* (2013.01); *E04H 9/021* (2013.01); *E01D 2101/26* (2013.01);
(Continued)

(58) Field of Classification Search
CPC ..... E04B 1/41; E04B 2001/4192; E04C 3/34; E04C 5/03; E04C 5/165; E04H 9/021;
(Continued)

(56) References Cited

U.S. PATENT DOCUMENTS 11,028,574 B2 * 6/2021 Guo ..... E04B 1/21
2020/0102751 A1 * 4/2020 Guo ..... E04C 5/165

FOREIGN PATENT DOCUMENTS

CN 103195170 A 7/2013
CN 106012809 A 10/2016
(Continued)

OTHER PUBLICATIONS

"Effect of reinforcing steel debonding on RC frame performance in resisting progressive collapse", Elsayed et al.; HBRC Journal; Feb. 2015 (Year: 2015).*
(Continued)

*Primary Examiner* — Ryan D Kwiecinski
(74) *Attorney, Agent, or Firm* — W&KIP

(57) ABSTRACT

The joint has a prefabricated-reinforced-concrete column, a reinforced-concrete foundation, a column anchoring longitudinal bar, a grouting sleeve and a foundation anchoring steel bar. The foundation anchoring steel bar and the column anchoring longitudinal bar are connected by a seam filling material filling the grouting sleeve. A splicing seam between the reinforced-concrete foundation and the prefabricated-reinforced-concrete column is filled with the seam filling material. The foundation anchoring steel bar includes a vertical portion and a horizontal portion. The vertical portion includes an upper-portion anchoring section protruding out of an upper surface of the reinforced-concrete foundation, a middle-portion non-adhesive section buried within the foundation and a lower-portion anchoring section. An exterior of the middle-portion non-adhesive section is provided with an
(Continued)

isolating sheath for isolating the middle-portion non-adhesive section and the concrete adhesion.

6 Claims, 7 Drawing Sheets

(51) Int. Cl.

| | |
|---|---|
| ***E04H 9/02*** | (2006.01) |
| ***E04B 1/41*** | (2006.01) |
| ***E02D 27/42*** | (2006.01) |
| *E01D 101/26* | (2006.01) |
| *E04B 2/56* | (2006.01) |

(52) U.S. Cl.
CPC ..... *E02D 27/42* (2013.01); *E04B 1/41* (2013.01); *E04B 2/56* (2013.01); *E04B 2001/4192* (2013.01); *E04C 3/34* (2013.01); *E04H 9/025* (2013.01)

(58) Field of Classification Search
CPC ..... E04H 9/025; E04H 12/12; E02D 27/42; E02D 2600/30
See application file for complete search history.

(56) References Cited

FOREIGN PATENT DOCUMENTS

| | | | | | |
|---|---|---|---|---|---|
| CN | 106592990 | A | | 4/2017 | |
| CN | 106948364 | A | * | 7/2017 | |
| CN | 107165185 | A | * | 9/2017 | ..... E04H 9/025 |
| CN | 107299641 | A | | 10/2017 | |
| CN | 107299641 | A | * | 10/2017 | ..... E04H 9/021 |
| CN | 207176717 | U | * | 4/2018 | |
| CN | 207176718 | U | | 4/2018 | |
| CN | 207176718 | U | * | 4/2018 | |
| CN | 207392609 | U | * | 5/2018 | |
| CN | 108221910 | A | * | 6/2018 | |
| CN | 108374489 | A | * | 8/2018 | |
| CN | 108425375 | A | * | 8/2018 | |
| CN | 208309577 | U | * | 1/2019 | |
| CN | 109680706 | A | * | 4/2019 | |
| CN | 208763187 | U | * | 4/2019 | |
| CN | 209353363 | U | * | 9/2019 | |
| CN | 111021234 | A | * | 4/2020 | |
| CN | 111042439 | A | * | 4/2020 | |
| CN | 210369306 | U | * | 4/2020 | |
| CN | 211369127 | U | * | 8/2020 | |
| CN | 211498443 | U | * | 9/2020 | |
| CN | 211713973 | U | * | 10/2020 | |
| CN | 212561127 | U | * | 2/2021 | |
| CN | 112575771 | A | * | 3/2021 | |
| CN | 212641948 | U | * | 3/2021 | |
| CN | 213979596 | U | * | 8/2021 | |
| JP | 2006233445 | A | | 9/2006 | |
| JP | 2020070681 | A | * | 5/2020 | |

OTHER PUBLICATIONS

Internatinal Search Report of PCT/CN2018/088162, dated Aug. 1, 2018.

* cited by examiner

PRECAST COLUMN BASE JOINT AND CONSTRUCTION METHOD THEREFOR

CROSS-REFERENCE TO RELATED APPLICATIONS

This application is a continuation of International Patent Application No. PCT/CN2018/088162 with a filing date of May 24, 2018, designating the United States, now pending, and further claims priority to Chinese Patent Application No. 201710407160.1 with a filing date of Jun. 2, 2017. The content of the aforementioned applications, including any intervening amendments thereto, are incorporated herein by reference.

TECHNICAL FIELD

The present disclosure relates to the field of assembled structure constructions, and particularly relates to a column base joint of assembled concrete frame structures and frame shear wall structures and constructing method thereof.

BACKGROUND

Currently in the commonly used assembled frame structures domestic and abroad, their column base joints are mainly connected by using grouting sleeves.

The column bases connected by grouting sleeves bear a large stress. The internal-to-column longitudinal bar bears the largest stress at the seam between the column base and the foundation, and the remaining longitudinal bars bear a smaller stress because they are wrapped by the concrete, whereby the deformation of the longitudinal bars is concentrated at the seam. By the load by earthquakes that rarely happen, the longitudinal bars at the seam may easily break due to the excessively large deformation, which damages the structure of the assembled construction. Moreover, grouting sleeves generally employ one-by-one grouting to each of sleeves, and the constructing efficiency at the joint at the seam is low.

SUMMARY

An object of the present disclosure is to provide an assembled column-base connection joint and constructing method thereof, in order to solve the technical problem of the column base joints of assembled structures of insufficient deformability and mechanical property.

In order to realize the above object, the present disclosure employs the following technical solutions:

An assembled column-base connection joint, comprising, a prefabricated-reinforced-concrete column at an upper portion and a reinforced-concrete foundation at a lower portion that are vertically correspondingly spliced, the prefabricated-reinforced-concrete column being pre-buried with a column anchoring longitudinal bar and a grouting sleeve that are circumferentially evenly distributed along a column body, the reinforced-concrete foundation being pre-buried with a foundation anchoring steel bar, the foundation anchoring s eel bar and the column anchoring longitudinal bar being connected by a seam filling material filling the grouting sleeve, and a splicing seam between the reinforced-concrete foundation and the prefabricated-reinforced-concrete column being filled with the seam filling material, wherein the foundation anchoring steel bar is of an L shape, and comprises a vertical portion and a horizontal portion, the vertical portion comprises an upper-portion anchoring section protruding out of an upper surface of the reinforced-concrete foundation, a middle-portion non-adhesive section buried within the foundation and a lower-portion anchoring section, the upper-portion anchoring section protrudes into the grouting sleeve and is connected to the column anchoring longitudinal bar, the middle-portion non-adhesive section does not have adhesion to a foundation concrete, and the lower-portion anchoring section and the horizontal portion are adhesively anchored to the foundation concrete, and an exterior of the middle-portion non-adhesive section is provided with an isolating sheath for isolating the middle-portion non-adhesive section and the concrete adhesion, and a top face of the isolating sheath and an upper surface of the reinforced-concrete foundation flush.

Optionally, a length of the middle-portion non-adhesive section is 3 to 20 times a diameter of the steel bar.

Optionally, the isolating sheath is a hard-material casing, and is a plastic tube or steel tube whose inner diameter is greater than a diameter of the middle-portion non-adhesive section, or the isolating sheath is a plastic-cloth layer that wraps the middle-portion non-adhesive section after the middle-portion non-adhesive section has been applied a dedicated anti-corrosive lubricant grease.

Optionally, the middle-portion non-adhesive section is provided with a necking section, the necking section has a cross-sectional area that is reduced to 50%-90% of an original cross-sectional area, and the isolating sheath is a hard-material casing.

Optionally, the necking section is a cross-section reduction that is formed by cutting, and the cross-section reduction is formed by reducing a diameter of a cross section of a steel bar of a reduction section or by cutting upper and lower sides or left and right sides of a steel bar to form a notch.

Optionally, the necking section is left at least one non-necking elastic section that is not cut, the non-necking elastic sections are evenly distributed on the necking section, and a total length of the non-necking elastic sections is not greater than a half of a total length of the necking section.

Optionally, the grouting sleeve is a sleeve in a form of no independent grout-injection hole whose side wall does not have a grout-injection hole and has merely a grout exiting hole, the prefabricated-reinforced-concrete column is provided with an internal-to-column grout flowing channel, the internal-to-column grout flowing channel has one end in communication with an exterior of the side wall to form a sole grout-injection hole, and the other end in communication with the splicing seam between the reinforced-concrete foundation and the prefabricated-reinforced-concrete column, and the splicing seam forms an external-to-column grout flowing channel of the grouting sleeve, wherein the seam filling material is grouted from the sole grout-injection hole, passes through the internal-to-column grout flowing channel, fills the splicing seam, then fills the grouting sleeve, and flows out of the grout exiting hole.

Optionally, the internal-to-column grout flowing, channel is of a reverse L shape, and comprises a horizontal channel and a vertical channel, the horizontal channel is in communication with the exterior of the side wall, the vertical channel is in communication with the splicing seam, and the vertical channel is located in a vertical axis of the prefabricated-reinforced-concrete column.

A method for constructing the assembled column-base connection joint, wherein steps of the constructing are as follows, Step 1: binding a foundation steel reinforcement cage and providing a template;

Step 2: processing the foundation anchoring steel bar;

Step 3: placing the foundation anchoring steel bar into a predetermined position in the template, installing the isolating sheath, and then pouring concrete to form the reinforced-concrete foundation;

Step 4: binding the column steel reinforcement cage, the column anchoring longitudinal bar and the grouting sleeve, providing a template, and pouring concrete to form the prefabricated-reinforced-concrete column;

Step 5: transporting the prefabricated-reinforced-concrete column to a site, temporarily placing in place, inserting the foundation anchoring steel bar into the grouting sleeve, providing a temporary support, and fixing to ensure a width of the splicing seam;

Step 6: filling the splicing seam by using the seam filling material, and then grouting, the seam filling material into the grouting sleeve; and Step 7: after the seam filling material within the grouting sleeve has reached a required strength, dismantling the temporary support of the prefabricated-reinforced-concrete column, to complete the constructing of the column base joint.

A method for constructing the assembled column-base connection joint, wherein steps of the constructing are as follows:

Step 1; binding a foundation steel reinforcement cage and providing a template;

Step 2: processing the foundation anchoring steel bar;

Step 3: placing the foundation anchoring steel bar into a predetermined position in the template, installing the isolating sheath, and then pouring concrete to form the reinforced-concrete foundation;

Step 4: binding the column steel reinforcement cage, the column anchoring longitudinal bar and the grouting sleeve, providing an external-to-column template and an internal template of the internal-to-column grout flowing channel, and pouring concrete to form the prefabricated-reinforced-concrete column and the internal-to-column grout flowing channel;

Step 5: transporting the prefabricated-reinforced-concrete column to a site, temporarily placing in place, inserting the foundation anchoring steel bar into the grouting sleeve, providing a temporary support, and fixing to ensure a width of the splicing, seam;

Step 6: grouting the seam filling material from the sole grout-injection hole, and the seam filling material passing through the internal-to-column grout flowing channel, filling the splicing seam, then filling the grouting sleeve, and flowing out of the grout exiting hole, to pour the steel-bar connecting sleeves to be full; and Step 7: after the seam filling material within the grouting sleeve has reached a required strength, dismantling the temporary support of the prefabricated-reinforced-concrete column, to complete the constructing of the column base joint.

As compared with the prior art, the present disclosure has the following characteristics and advantageous effects:

The connection joint of the present disclosure improves the deformability and mechanical property of the column base joint of the assembled structure, can be constructed efficiently and has a good earthquake-resistant performance. The assembled column base joint can be easily repaired after an earthquake. The connection joint of the present disclosure has a good earthquake-resistant performance. The constructing method of the present disclosure has a simple process and a high constructing speed.

In the connection joint of the present disclosure, the foundation anchoring steel bar is provided with the non-adhesive section, to distribute the deformation of the steel bar to the entire non-adhesive section of the steel bar, which greatly reduces the maximum strain of the steel bar, and can ensure to a certain extent that the stressed steel bar does not have an excessively large deformation under the action of designed earthquakes that rarely happen, thereby preventing the steel bar from being damaged.

The present disclosure can also, by performing cross-section reduction to the non-adhesive section, reduce the strain permeation effect of the steel bar, and further concentrate the deformation of the steel bar at the cross-section reduction section, which reduces the probable risk of damage to the sleeve connection or the yield failure of the steel bar of the adhesion section.

The present disclosure can also provide one or more elastic support sections in the cross-section reduction section, which reduces the risk of flexure of the cross-section reduction section, and can further improve the energy consumption performance of the reduction section under hysteresis loading.

In the present disclosure, in order to further improve the deformability of the prefabricated column, and reduce the degree of the damage to the structure under the action of the designed earthquakes that rarely happen, the column base of the prefabricated column may be wrapped by a steel plate having a certain thickness and height, which reduces the degree of the compression failure of the column-base concrete.

In the present disclosure, in order to further improve the constructing efficiency of the joint, a technique of simple hole grouting may be employed, whereby it is not required to grout the sleeves one by one, and the grouting can be performed at the sole grout-injection hole.

The present disclosure can be applied to various high-rise public buildings, such as schools, office buildings, apartments and hospitals.

BRIEF DESCRIPTION OF THE DRAWINGS

The present disclosure will be described below in further details by referring to the drawings.

Reference numbers: 1—prefabricated-reinforced-concrete column, 2—reinforced-concrete foundation, 3—column anchoring longitudinal bar, 4—grouting sleeve, 5—sole grout-injection hole, 6—foundation anchoring steel bar, 7—seam filling material, 8—vertical portion, 81—upper-portion anchoring section, 82—middle-portion non-adhesive section, 821—necking section, 822—non-necking elastic section, 83—lower-portion anchoring section, 9—horizontal portion, 10—isolating sheath, 11—grout exiting hole, 12—internal-to-column grout flowing channel, 121—horizontal channel, 122—vertical channel, and 13—contour line of original cross section.

DETAILED DESCRIPTION

Figure 1:
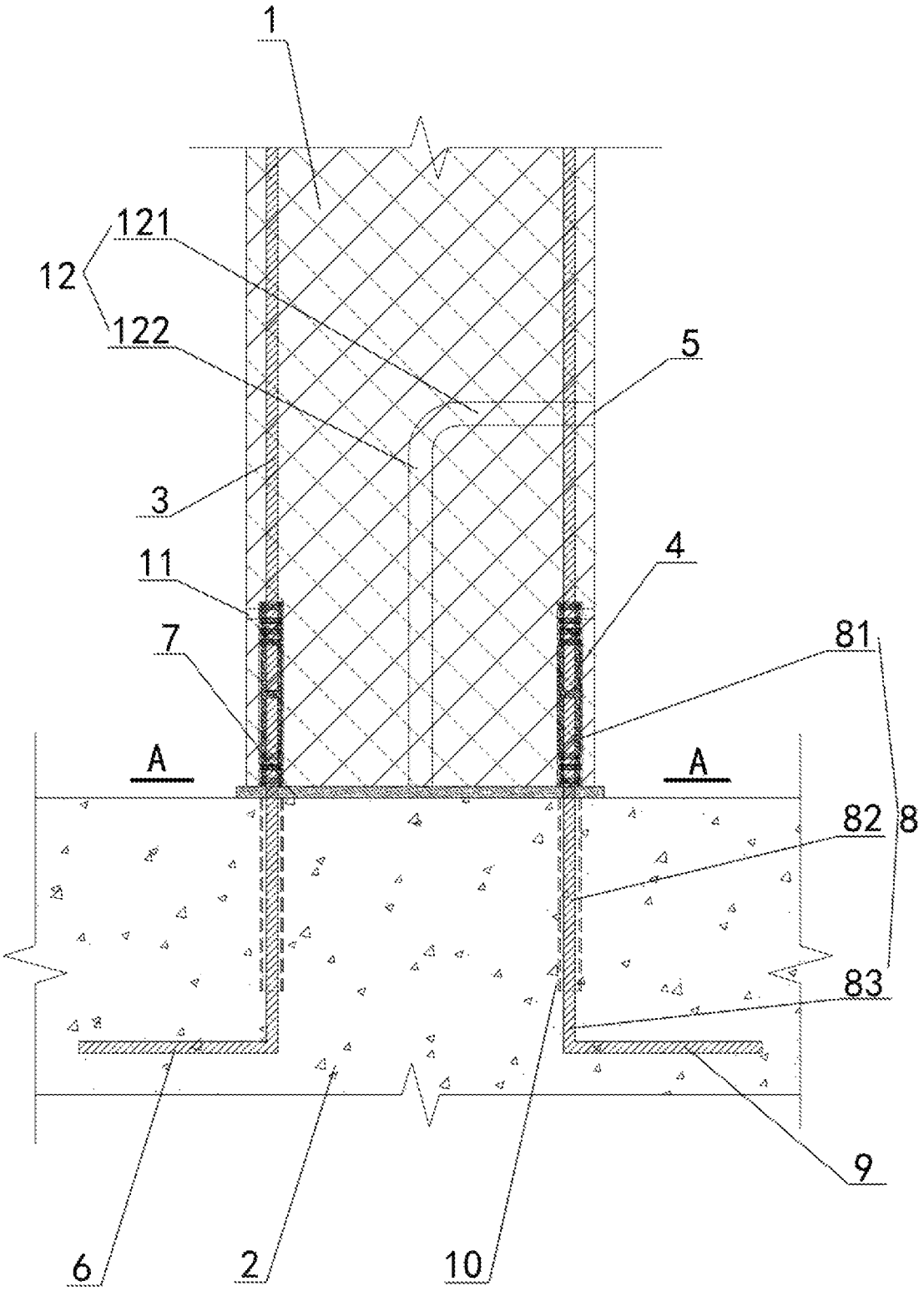
FIG. 1 is a schematic diagram of the column base joint of an embodiment of the present disclosure.
Figure 2:
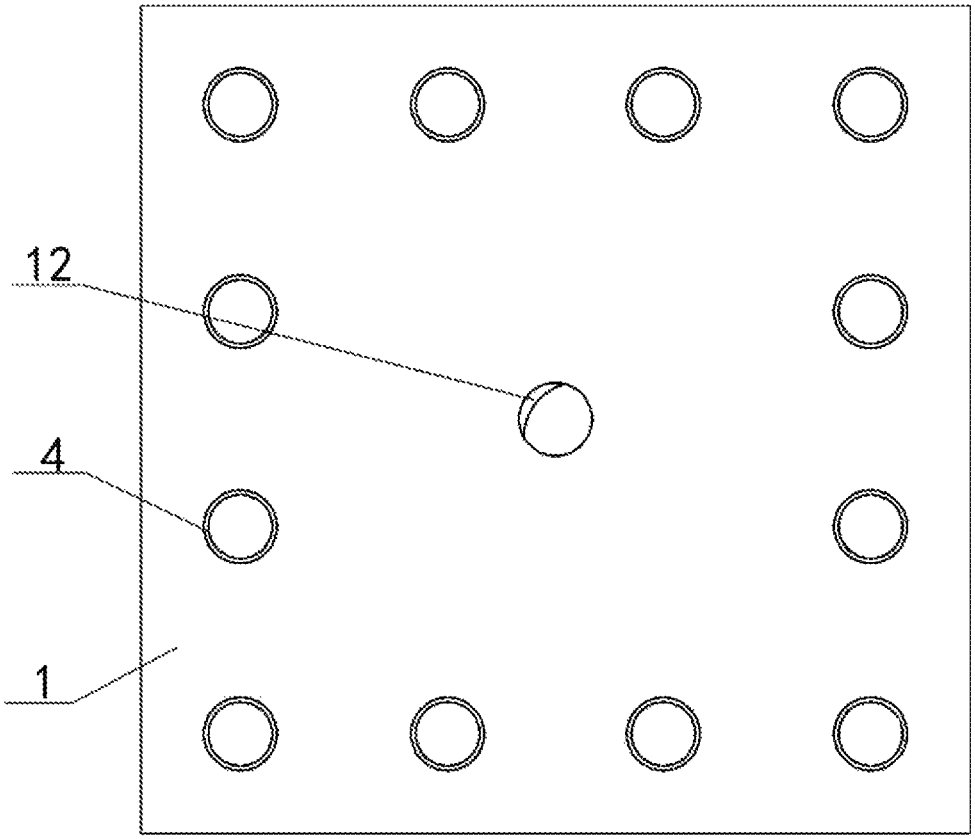
FIG. 2 is a schematic diagram of the A-A section of FIG. 1.

The embodiment is shown in FIGS. 1-2. An assembled column-base connection joint comprises a prefabricated-reinforced-concrete column 1 at the upper portion and a reinforced-concrete foundation 2 at the lower portion that are vertically correspondingly spliced. The prefabricated-reinforced-concrete column 1 is pre-buried with a column anchoring longitudinal bar 3 and a grouting sleeve 4 that are circumferentially evenly distributed along the column body. The reinforced-concrete foundation 2 is pre-buried with a foundation anchoring steel bar 6. The foundation anchoring steel bar 6 and the column anchoring longitudinal bar 3 are connected by a seam filling material 7 filling the grouting sleeve 4. A splicing seam between the reinforced-concrete foundation 2 and the prefabricated-reinforced-concrete column 1 is filled with the seam filling material 7. The grouting sleeve 4 is a conventional grouting sleeve.

The seam filling material is a high-strength quick-hardening-cement-based grouting material or a steel fiber, carbon fiber or other fiber quick-hardening-cement-based grouting material or a polymer mortar material that have a compressive strength above 45 MPa.

The foundation anchoring steel bar 6 is of an L shape, and comprises a vertical portion 8 and a horizontal portion 9. The vertical portion comprises an upper-portion anchoring section 81 protruding out of the upper surface of the reinforced-concrete foundation 2, a middle-portion non-adhesive section 82 buried within the foundation and a lower-portion anchoring section 83. The upper-portion anchoring section 81 protrudes into the grouting sleeve 4 and is connected to the column anchoring longitudinal bar 3. The middle-portion non-adhesive section 82 does not have adhesion to the foundation concrete. The lower-portion anchoring section 83 and the horizontal portion 9 are adhesively anchored to the foundation concrete.

The exterior of the middle-portion non-adhesive section 82 is provided with an isolating sheath 10 for isolating the middle-portion non-adhesive section 82 and the concrete adhesion. The top face of the isolating sheath 10 and the upper surface of the reinforced-concrete foundation 2 flush.

The length of the middle-portion non-adhesive section 82 is required to be determined by calculation. Checking calculation on flexure stability should be performed to ensure that it is not flexurally damaged, to the extent that can ensure that the steel bar of the structure does not have an excessively large plastic deformation at the design ultimate load to result in structure damage. Generally the length is 3 to 20 times the diameter of the steel bar.

Figure 7:
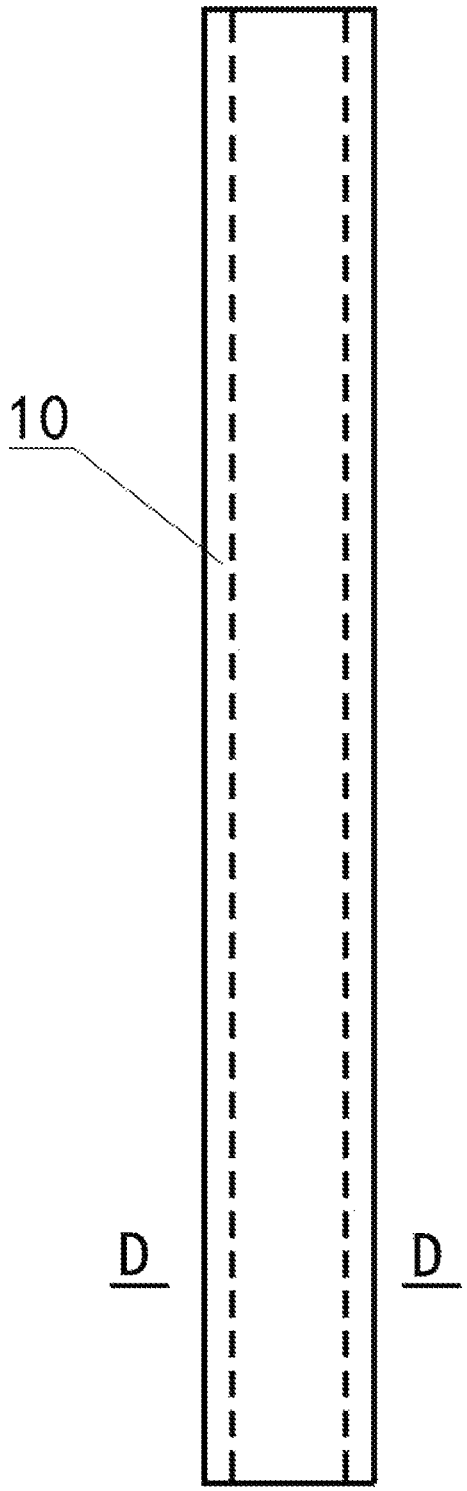
FIG. 7 is a schematic diagram of the present disclosure wherein the isolating sheath is a hard-material casing.
Figure 8:
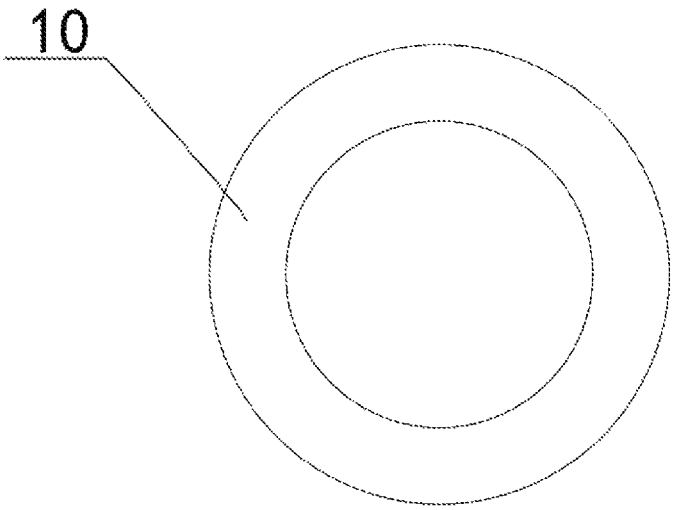
FIG. 8 is a schematic diagram of the D-D section of FIG. 7.

The isolating sheath 10 is a hard-material casing, and is a plastic tube or steel tube whose inner diameter is greater than the diameter of the middle-portion non-adhesive section, or the isolating sheath 10 is a plastic-cloth layer that wraps the middle-portion non-adhesive section after the middle-portion non-adhesive section has been applied a dedicated anti-corrosive lubricant grease. As shown in FIGS. 7-8, in the present embodiment it is a hard-material casing.

Figure 3:
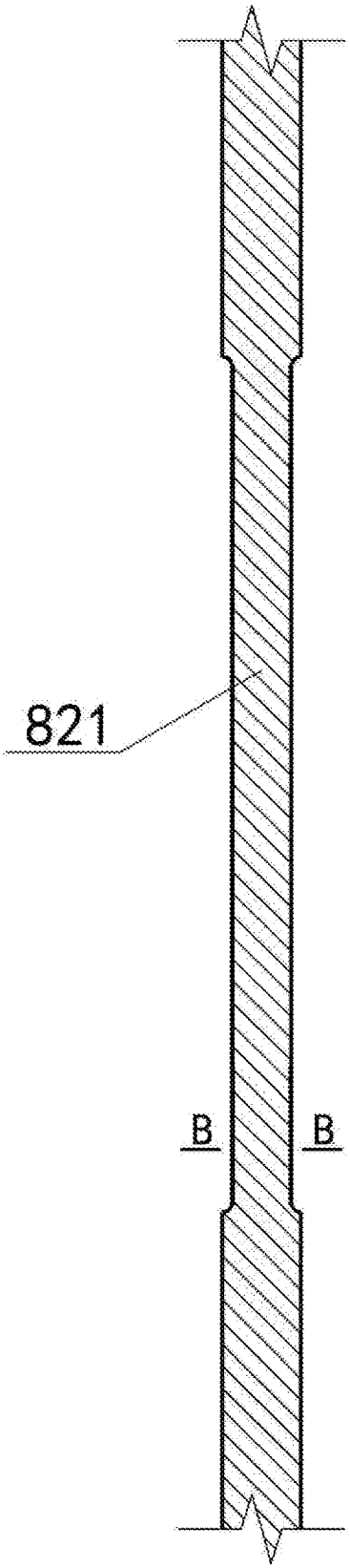
FIG. 3 is a schematic diagram of the energy consuming steel-bar necking section of the foundation anchoring steel bar of an embodiment of the present disclosure.
Figure 5:
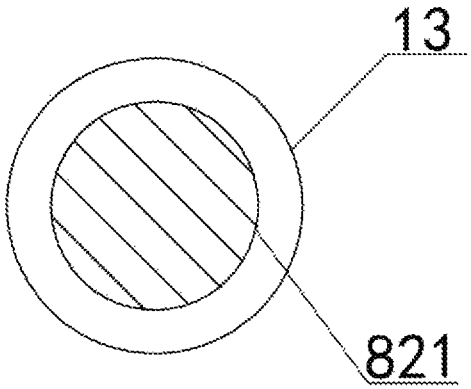
FIG. 5 is a schematic diagram of the B-B section of FIG. 3, which is the mode of cross-section reduction by reducing the diameter of the cross section of the steel bar of the reduction section.
Figure 6:
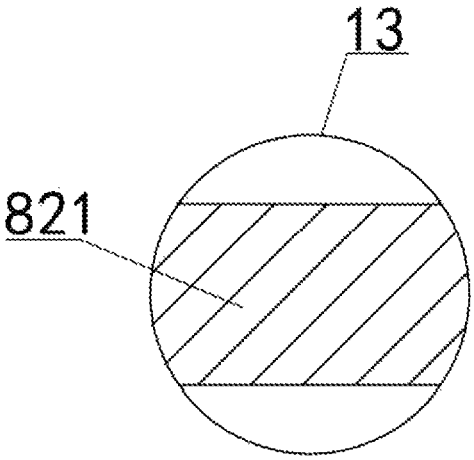
FIG. 6 is a schematic diagram of the C-C section of FIG. 4, which is the mode of cross-section reduction by cutting the upper and lower sides of the steel bar to form a notch.

As shown in FIG. 3, further in another embodiment, the middle-portion non-adhesive section 82 may also be provided with a necking section 821, and the necking section 821 has a cross-sectional area that is reduced to 50%-90% of the original cross-sectional area, in which case the isolating sheath 10 must be a hard-material casing. The necking section is a cross-section reduction that is formed by cutting, and the cross-section reduction is formed by reducing the diameter of the cross section of the steel bar of a reduction section or by cutting upper and lower sides or left and right sides of the steel bar to form a notch. As shown in FIGS. 5 and 6, the contour line 13 of the original cross section is also shown in the figures.

Figure 4:
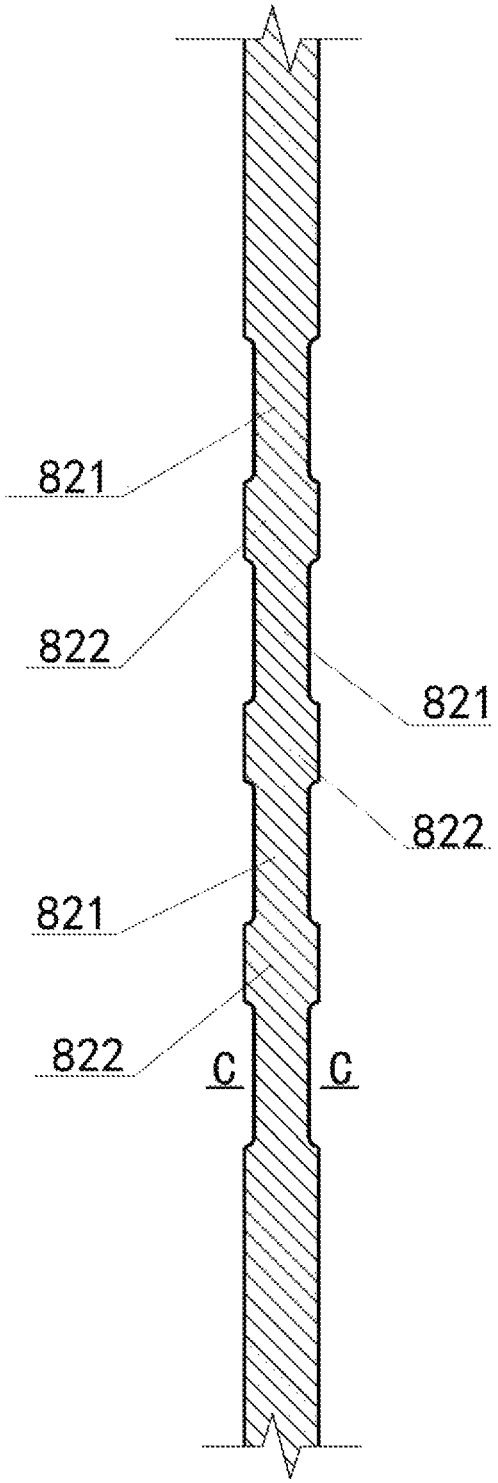
FIG. 4 is a schematic diagram of the energy consuming steel-bar necking section and the non-necking elastic section of the foundation anchoring steel bar of an embodiment of the present disclosure.

As shown in FIG. 4, further in another embodiment, the necking section 821 may also be treated by sectional cutting, to leave at least one non-necking elastic section 822 that is not cut, which is generally 1-5 sections. The non-necking elastic sections can provide elastic support to the necking section in yielding and in turn improve the energy consumption performance of the necking section and the mechanical property of the column base joint. The non-necking elastic sections 822 are evenly distributed on the necking section 821. The non-necking elastic sections 822 divide the necking section into a plurality of subsections of similar lengths. The total length of the non-necking elastic sections 822 is not greater than a half of the total length of the necking section 821.

In the present embodiment, as shown in FIG. 1, the grouting sleeve 4 is a sleeve in the form of no independent grout-injection hole whose side wall does not have a grout-injection hole and has merely a grout exiting hole 11. The prefabricated-reinforced-concrete column 1 is provided with an internal-to-column grout flowing channel 12. The internal-to-column grout flowing channel has one end in communication with the exterior of the side wall to form a sole grout-injection hole 5, and the other end in communication with the splicing seam between the reinforced-concrete foundation 2 and the prefabricated-reinforced-concrete column 1. The seam filling material 7 is grouted from the sole grout-injection hole 13, passes through the internal-to-column grout flowing channel 12, fills the splicing seam, then fills the grouting sleeve 4, and flows out of the grout exiting hole 11.

At the moment, the splicing seam serves as a measure for eliminating the set-up error in the installation process, and also serves as the external-to-column grout flowing channel of the sleeve in the form of no independent grout-injection hole. The width of the splicing seam is 20-30 mm. The edge of the seam filling material that is at the splicing seam exceeds the edge of the prefabricated-reinforced-concrete column.

As shown in FIG. 1, the internal-to-column grout flowing channel 12 is of a reverse L shape, and comprises a horizontal channel 121 and a vertical channel 122. The horizontal channel 121 is in communication with the exterior of the side wall. The vertical channel 122 is in communication with the splicing seam. The vertical channel 122 is located in the vertical axis of the prefabricated-reinforced-concrete column 1.

A method for constructing the assembled column-base connection joint comprises the steps of the constructing as follows:

Step 1: binding a foundation steel reinforcement cage and providing a template;

Step 2: processing the foundation anchoring steel bar;

Step 3: placing the foundation anchoring, steel bar 6 into a predetermined position in the template, installing the isolating sheath, and then pouring, concrete to form the reinforced-concrete foundation 2;

Step 4: binding the column steel reinforcement cage, the column anchoring longitudinal bar 3 and the grouting sleeve 4, providing a template, and pouring concrete to form the prefabricated-reinforced-concrete column 1;

Step 5: transporting the prefabricated-reinforced-concrete column 1 to a site, temporarily placing in place, inserting the foundation anchoring steel bar 6 into the grouting sleeve 4, providing a temporary support, and fixing to ensure a width of the splicing seam; wherein the position of the surface of the foundation where the prefabricated column is installed and the bottom face of the prefabricated column should be treated to be a coarse surface or be provided with a shear key slot to ensure the reliability of the shear resistance of the joint, and in performing the coarse surface treatment, the position of the template is coated a retarder, stripped, and washed by using high-pressure water, to form the coarse surface;

Step 6: filling the splicing seam by using the seam filling material 7, and then grouting the seam filling material 7 into the grouting sleeve; and Step 7: after the seam filling material within the grouting sleeve has reached a required strength, dismantling the temporary support of the prefabricated-reinforced-concrete column 1, to complete the constructing of the column base joint.

A method for constructing the assembled column-base connection joint comprises the steps of the constructing as follows:

Step 1: binding a foundation steel reinforcement cage and providing a template;

Step 2: processing the foundation anchoring steel bar;

Step 3: placing the foundation anchoring steel bar 6 into a predetermined position in the template, installing the isolating sheath 10, and then pouring concrete to form the reinforced-concrete foundation 2;

Step 4: binding the column steel reinforcement cage, the column anchoring longitudinal bar 3 and the grouting sleeve 4, providing an external-to-column template and an internal template of the internal-to-column grout flowing channel 12, and pouring concrete to form the prefabricated-reinforced-concrete column 1 and the internal-to-column grout flowing channel 12;

Step 5: transporting the prefabricated-reinforced-concrete column 1 to a site, temporarily placing in place, inserting the foundation anchoring steel bar 6 into the grouting sleeve 4, providing a temporary support, and fixing to ensure a width of the splicing seam; wherein the position of the surface of the foundation where the prefabricated column is installed and the bottom face of the prefabricated column should be treated to be a coarse surface or be provided with a shear key slot to ensure the reliability of the shear resistance of the joint, and in performing the coarse surface treatment, the position of the template is coated a retarder, stripped, and washed by using high-pressure water, to form the coarse surface;

Step 6: grouting the seam filling material 7 from the sole grout-injection hole 5, and the seam filling material 7 passing through the internal-to-column grout flowing channel 1, filling the splicing seam, then filling the grouting sleeve 4, and flowing out of the grout exiting hole 11, to pour the steel-bar connecting sleeves to be full; and Step 7: after the seam filling material within the grouting sleeve has reached a required strength, dismantling the temporary support of the prefabricated-reinforced-concrete column 1, to complete the constructing of the column base joint.

In practical constructing, the foundation may be prefabricated in a plant and may also be site-poured in the construction site. Moreover, in order to monitor the strain state of the anchoring steel bar, the middle-portion non-adhesive section on the four foundation anchoring steel bars at the corners of the connection joint may be provided with strain gauges, and in practical engineering the key stressed column base joints can be spot tested to perform strain monitoring of the middle-portion non-adhesive section.

The area of the column bottom of the prefabricated-reinforced-concrete column may be enclosed by a coating steel plate, which further improves the ductility of the column-base concrete, and alleviates the degree of the damage to the column base of the prefabricated column under the action of earthquakes. When the column base is treated by using the coating steel plate, the coating steel plate of the column base is poured together with the prefabricated column by using a bolt. Its thickness should be determined by calculation, to the extent that can satisfy the requirements on the constriction on the column-base concrete and ensure that the column-base concrete is not pressed to failure at the design ultimate pad. The height of the coating steel plate should be determined by calculation, to ensure that the column cross section that is adjacent to the upper end of the coating steel plate of the prefabricated column is not damaged under the load of earthquakes that rarely happen.

We claim:

1. An assembled column-base connection joint, comprising a prefabricated-reinforced-concrete column (1) at an upper portion and a reinforced-concrete foundation (2) at a lower portion that are vertically correspondingly spliced, the prefabricated-reinforced-concrete column (1) being pre-buried with a column anchoring longitudinal bar (3) and a grouting sleeve (4) that are circumferentially evenly distributed along a column body, the reinforced-concrete foundation (2) being pre-buried with a foundation anchoring steel bar (6), the foundation anchoring steel bar (6) and the column anchoring longitudinal bar (3) being connected by a seam filling material (7) filling the grouting sleeve (4), and a splicing seam between the reinforced-concrete foundation (2) and the prefabricated-reinforced-concrete column (1) being filled with the seam filling material (7), wherein the foundation anchoring steel bar (6) is of an L shape, and comprises a vertical portion (8) and a horizontal portion (9), the vertical portion comprises an upper-portion anchoring section (81) protruding out of an upper surface of the reinforced-concrete foundation (2), a middle-portion non-adhesive section (82) buried within the foundation and a lower-portion anchoring section (83), the upper-portion anchoring section (81) protrudes into the grouting sleeve (4) and is connected to the column anchoring longitudinal bar (3), the middle-portion non-adhesive section (82) does not have adhesion to a foundation concrete, and the lower-portion anchoring section (83) and the horizontal portion (9) are adhesively anchored to the foundation concrete, and an exterior of the middle-portion non-adhesive section (82) is provided with an isolating sheath (10) for isolating the middle-portion non-adhesive section (82) and the concrete adhesion, and a top face of the isolating sheath (10) and an upper surface of the reinforced-concrete foundation (2) flush, wherein a length of the middle-portion non-adhesive section (82) is 3 to 20 times a diameter of the steel bar, wherein the isolating sheath (10) is a hard-material casing, and is a plastic tube or steel tube whose inner diameter is greater than a diameter of the middle-portion non-adhesive section, or the isolating sheath (10) is a plastic-cloth layer that wraps the middle-portion non-adhesive section after the middle-portion non-adhesive section has been applied a dedicated anti-corrosive lubricant grease;

wherein the middle-portion non-adhesive section (82) is provided with a necking section (821), the necking section (821) has a cross-sectional area that is reduced 20 to 50%-90% of an original cross-sectional area, and the isolating sheath (10) is a hard-material casing.

2. The assembled column-base connection joint according to claim 1, wherein the necking section is a cross-section reduction that is formed by cutting, and the cross-section reduction is formed by reducing a diameter of a cross section of a steel bar of a reduction section or by cutting upper and lower sides or left and right sides of a steel bar to form a notch.

3. The assembled column-base connection joint according to claim 1, wherein the necking section (821) is left at least one non-necking elastic section (822) that is not cut, the non-necking elastic sections (822) are evenly distributed on the necking section (821), and a total length of the non-necking elastic sections (822) is not greater than a half of a total length of the necking section (821).

4. The assembled column-base connection joint according to claim 1, wherein the grouting sleeve (4) is a sleeve in a form of no independent grout-injection hole whose side wall does not have a grout-injection hole and has merely a grout exiting hole (11), the prefabricated-reinforced-concrete column (1) is provided with an internal-to-column grout flowing channel (12), the internal-to-column grout flowing channel has one end in communication with an exterior of the side wall to form a sole grout-injection hole (5), and the other end in communication with the splicing seam between the reinforced-concrete foundation (2) and the prefabricated-reinforced-concrete 21 column (1), and the splicing seam forms an external-to-column grout flowing channel of the grouting sleeve (4), wherein the seam filling material (7) is grouted from the sole grout-injection hole (13), passes through the internal-to-column grout flowing channel (12), fills the splicing seam, then fills the grouting sleeve (4), and flows out of the grout exiting hole (11).

5. The assembled column-base connection joint according to claim 4, wherein the internal-to-column grout flowing channel (12) is of a reverse L shape, and comprises a horizontal channel (121) and a vertical channel (122), the horizontal channel (121) is in communication with the exterior of the side wall, the vertical channel (122) is in communication with the splicing seam, and the vertical channel (122) is located in a vertical axis of the prefabricated-reinforced-concrete column (1).

6. A method for constructing the assembled column-base connection joint according to claim 4, wherein steps of the constructing are as follows:

Step 1: binding a foundation steel reinforcement cage and providing a template;

Step 2: processing the foundation anchoring steel bar;

Step 3: placing the foundation anchoring steel bar (6) into a predetermined position in the template, installing the isolating sheath (10), and then pouring concrete to form the reinforced-concrete foundation (2);

Step 4: binding the column steel reinforcement cage, the column anchoring longitudinal bar (3) and the grouting sleeve (4), providing an external-to-column template and an internal template of the internal-to-column grout flowing channel (12), and pouring concrete to form the prefabricated-reinforced-concrete column (1) and the internal-to-column grout flowing channel (12);

Step 5: transporting the prefabricated-reinforced-concrete column (1) to a site, temporarily placing in place, inserting the foundation anchoring steel bar (6) into the grouting sleeve (4), providing a temporary support, and fixing to ensure a width of the splicing seam;

Step 6: grouting the seam filling material (7) from the sole grout-injection hole (5), and the seam filling material (7) passing through the internal-to-column grout flowing channel (1), filling the splicing seam, then filling the grouting sleeve (4), and flowing out of the grout exiting hole (11), to pour the steel-bar connecting sleeves to be full; and Step 7: after the seam filling material within the grouting sleeve has reached a required strength, dismantling the temporary support of the prefabricated-reinforced-concrete column (1), to complete the constructing of the column base joint.

* * * * *